US006588344B2

(12) United States Patent
Clark et al.

(10) Patent No.: US 6,588,344 B2
(45) Date of Patent: Jul. 8, 2003

(54) OIL WELL PERFORATOR LINER

(75) Inventors: Nathan G. Clark, Mansfield, TX (US); David John Leidel, Arlington, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/810,966

(22) Filed: Mar. 16, 2001

(65) Prior Publication Data

US 2002/0129724 A1 Sep. 19, 2002

(51) Int. Cl.[7] ..... F42B 1/02
(52) U.S. Cl. ..... 102/307; 102/306; 102/476
(58) Field of Search ..... 102/306, 307, 102/476

(56) References Cited

U.S. PATENT DOCUMENTS 3,948,181 A * 4/1976 Bergstrom ..... 102/307
4,498,367 A 2/1985 Skolnick et al. ..... 86/1 R
4,784,062 A * 11/1988 Rudolf et al. ..... 102/476
4,794,990 A 1/1989 Riggs ..... 166/902
4,867,061 A * 9/1989 Stadler et al. ..... 102/307
5,567,906 A 10/1996 Reese et al. ..... 102/307
5,656,791 A * 8/1997 Reese et al. ..... 102/307
5,792,977 A * 8/1998 Chawla ..... 102/307
5,814,758 A 9/1998 Leidel ..... 102/307
5,827,995 A * 10/1998 Graham ..... 102/307
5,939,664 A * 8/1999 Kapoor ..... 102/307 X
6,250,229 B1 * 6/2001 Kerdraon et al. ..... 102/476
6,308,634 B1 * 10/2001 Fong ..... 102/476
6,354,219 B1 * 3/2002 Pratt et al. ..... 102/476

* cited by examiner

*Primary Examiner*—Peter A. Nelson
(74) *Attorney, Agent, or Firm*—John F. Booth

(57) ABSTRACT

A shaped charge apparatus having an improved liner for a shaped charge constructed from a combination of powdered metal and selected polymer material. Powdered heavy metal and polymer binder is compressively formed into a rigid shaped charge liner under very high pressure. The polymer binder may be in powdered form and or also be used to coat the powdered metal particles prior to compression. The compressed liner may also contain a relatively small percentage of other material to enhance lubrication or corrosion resistance.

39 Claims, 2 Drawing Sheets

OIL WELL PERFORATOR LINER

TECHNICAL FIELD

A shaped charge suitable for use in a perforating tool for a subterranean well is described. The invention relates particularly to an improved shaped charge liner constructed from compressed powdered heavy metal and polymer material.

BACKGROUND OF THE INVENTIONS

A subterranean gas or oil well typically begins with a hole bored into the earth, which is then lined with joined lengths of relatively large diameter metal pipe. The casing thus formed is generally cemented to the face of the hole to give the well integrity and a path for producing fluids to the surface. Conventionally, the casing and cement are subsequently perforated with chemical means, commonly explosives, in one or more locations of the surrounding formation from which it is desired to extract fluids. In general, the perforations extend a distance into the formation. One of the problems inherent in the art is to maximize the depth of penetration into the formation.

Explosive shaped charges known in the art generally have a substantially cylindrical or conical shape and are used in various arrangements in perforating tools in subterranean wells. Generally, a tubular perforating gun adapted for insertion into a well is used to carry a plurality of shaped charges to a subsurface location where perforation is desired. Upon detonation of the shaped charges, explosive jets emanate from the shaped charges with considerable velocity and perforate the well casing and surrounding formation.

Liners of shaped charges have commonly been designed in an effort to maximize penetration depth. Various metals have been used. Solid metal liners have the disadvantage of introducing metal fragments into the formation, detracting from the effectiveness of the perforation. In order to overcome this problem, compressed powdered metal liners have sometimes been used. Such liners disintegrate upon detonation of the shaped charge, avoiding the problems associated with metal fragments. It is known in the art that heavy metals are particularly suited for use in liners. Generally, the heavy metal is combined with one or more other metals with suitable binding characteristics to improve the formation of rigid liners through very high compression of the metal powders. One of the principal problems in the art has been the attempt to increase the heavy metal content of liners. Such attempts are outlined in U.S. Pat. Nos. 5,656,791 and 5,814,758, which are incorporated herein for all purposes by this reference.

Success in the art of producing compressed powdered heavy metal liners has been limited by efforts to identify suitable binding agents among elemental metals and alloys. A particularly serious problem is encountered since the material properties of the various constituents of the metal powder can vary, specifically, particle size, particle shape, and particle density. The blending of the mixture must be done very carefully to avoid segregation of the powder constituents resulting in a poorly performing liner. Further difficulties are encountered with powdered metal liners in that the metals are subject to corrosion. Efforts have been made to coat the completed liners with oil or other material to inhibit corrosion. These efforts have met with imperfect success. Another problem with powdered metal liner known in the art has been the need for added lubricant to facilitate manufacturing the pressed liners. Commonly, powdered graphite is added to the powdered metal mixture, which necessarily reduces the quantity of heavy metal that can be included in the finished liner.

After much research and study, the present invention employs various polymers in combination with heavy metal powders to produce an improved shaped charge compressed liner. The invention facilitates a higher heavy metal content resulting in improved liner performance. The liners of the invention also have improved corrosion resistance and a decreased need for lubricant additives.

SUMMARY OF THE INVENTIONS

The inventions provide shaped charge apparatus for use in a subterranean well. In general, the inventions contemplate an improved liner for a shaped charge constructed from a combination of powdered metal and selected polymer material.

According to one aspect of the invention, a mixture of powdered heavy metal and powdered polymer binder is compressively formed into a rigid shaped charge liner.

According to another aspect of the invention, a liner for a shaped charge is constructed of a polymer-coated heavy metal powder compressively formed into a rigid shaped charge liner.

According to still another aspect of the invention, a liner for a shaped charge is constructed from a mixture of powdered heavy metal and powdered polymer binder blended with a polymer-coated heavy metal powder and compressively formed into a substantially conical rigid body.

BRIEF DESCRIPTION OF THE DRAWINGS

The accompanying drawings are incorporated into and form a part of the specification to illustrate several examples of the present inventions. These drawings together with the description serve to explain the principals of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

DETAILED DESCRIPTION

Figure 1:
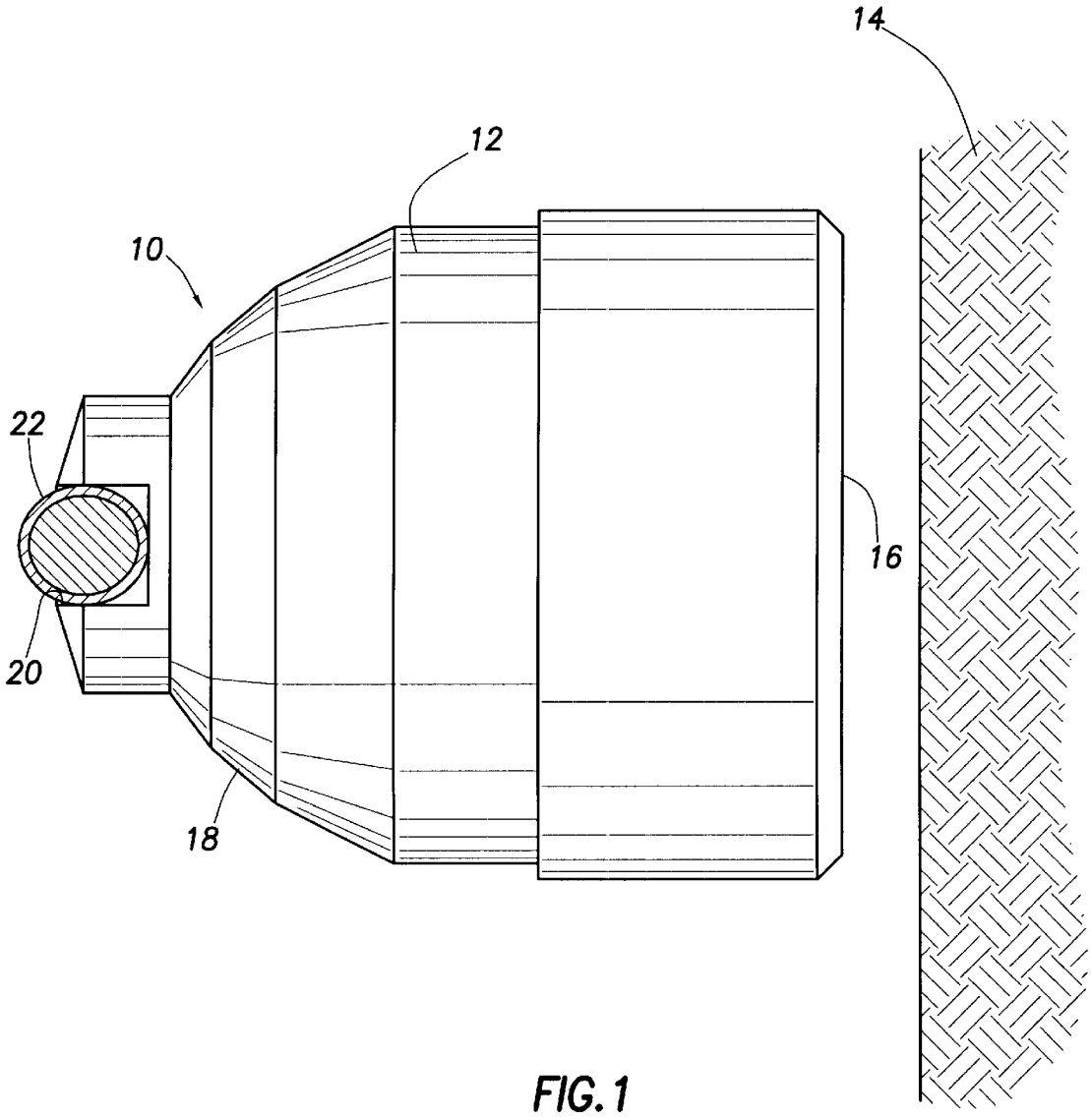
FIG. 1 is a side elevation view of an example of an axially symmetrical shaped charge in accordance with the invention.

The present inventions are described by reference to drawings showing one or more examples of how the inventions can be made and used. In these drawings, reference characters are used throughout the several views to indicate like or corresponding parts. The drawings are not necessarily to scale and the proportions of certain parts have been exaggerated to better illustrate details and features of the invention.

Figure 2:
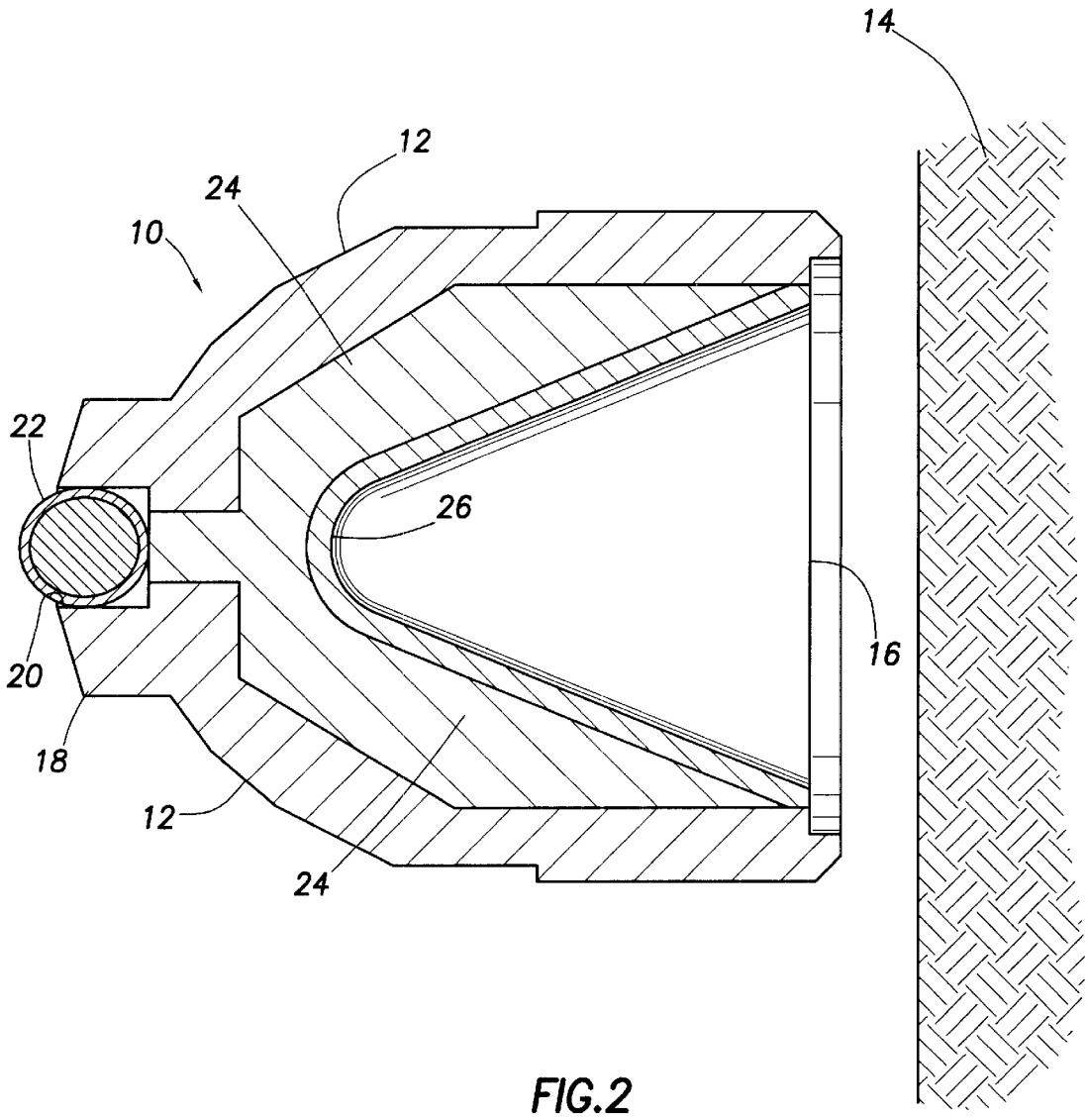
FIG. 2 is cross-sectional view taken along line 2—2 of FIG. 1 showing an example of an embodiment of a shaped charge in accordance with the inventions.

The apparatus and methods of the invention are shown generally in FIGS. 1 and 2. A conically symmetrical shaped charge 10 is shown. The shaped charge is sized for a perforating gun commonly used to perforate subterranean wells and formations. Typically, a plurality of shaped charges are arranged in a substantially helical pattern on the perforating gun assembly. The exact size and shape of the shaped charge or the configuration of the perforating gun are not critical to the invention. The shaped charge 10 is enclosed by a case 12. Generally, the case 12 is substantially cylindrical or conical. As used herein, the term "conical" is used to refer to shapes substantially conical or in the form of a frustum or truncated cone. Again, the exact shape of the case is not critical to the invention. In use, the perforating gun (not shown) is placed in a subterranean location where perforation of the well casing and/or formation is desired, herein designated the target 14. The shaped charge has a muzzle 16, which is oriented toward the target 14, and an opposing closed end 18.

Now referring primarily to FIG. 2, the case 10 is shown in cross section, revealing that the closed end 18 has a relatively small aperture 20 connected to a detonation cord 22. The detonation cord 22 is typically connected to a detonation circuit (not shown) known in the art. The case 10 contains a predetermined amount of high explosives 24 generally known in the arts, for example, RDX, HMX, HNS, CL-20, NONA, BRX, PETN, or PYX. A substantially conical liner 26 is disposed inside the case 12 between the high explosive 24 and the muzzle 16, preferably such that the high explosive 24 fills the volume between the casing 12 and the liner 26. The liner is typically affixed to the case with adhesive (not shown), but a retaining ring or spring may also be used. Upon detonation of the high explosive 24, the liner 26 disintegrates and the liner material is propelled through the muzzle 16 into the target 14. As known to those skilled in the arts, it is advantageous for the liner to disintegrate upon detonation of the high explosive and to have the maximum possible mass and velocity.

Further referring primarily to FIG. 2, the liner 26 is preferably constructed by compressing powdered metal and powdered polymer binder material under very high pressure to form a rigid body. The process of compressively forming the liner from powdered metal and polymer binder material is understood by those skilled in the arts. The powdered metal is preferably tungsten, but may be any metal or mixture of metals. Metals with high density, high ductility, and capable of achieving high acoustic velocity are preferred. Metals chosen from the group tungsten, tantalum, hafnium, lead, bismuth, tin, and copper are particularly suitable, although other metals may be used, cost is often a major factor. Preferably, the percentage of heavy metal, preferably tungsten, in the liner is within a range of approximately 99.0% to 99.98% by weight. Optionally, percentages within a range of approximately 90.0% to 99.8% may be used.

The percentage of polymer, preferably TEFLON, a registered trademark, in the mixture is preferably within a range of approximately 0.02% to 1.0% by weight, although percentages within a range of approximately 1.0% to 10.0% may also be used. Optionally, other polymers maybe used such as for example, a fluorocarbon chosen from but not limited to the group polytetrafluoroethylene, polybutadienes, and polyimides.

The invention has the advantages of reducing the difficulty in maintaining uniformity in the powdered metal mixture and in raising the percentage of heavy metal in the liner to higher levels than have been known in the art.

Optionally, the liner 26 may also contain approximately 0.02% to 1.0% lubricant by weight. Powdered graphite is a preferred lubricant known in the arts, although oils may also be used. Some oils such as linseed oil or tung oil, or other unsaturated organic compounds as disclosed in U.S. Pat. No. 4,794,990, which is incorporated in its entirety for all purposes by this reference, are helpful in preventing corrosion of the powdered metal of the liner.

The presently most preferred embodiment of the invention uses a liner 26 constructed from a polymer-coated heavy metal powder compressively formed into a rigid body. The process of coating the heavy metal powder with a polymer is understood by those skilled in the arts. The polymer-coated heavy metal powder is then compressed under very high pressure into a rigid body. Presently, tungsten and TEFLON are preferred for the heavy metal and polymer coating respectively, although the alternative metals and polymers described with reference to the above embodiment may be used. Preferably, the percentage of tungsten in the liner is within a range of approximately 99.0% to 99.98% by weight, although percentages within a range of approximately 90.0% to 99.98% may be used. The percentage of TEFLON, a registered trademark, in the mixture is preferably within a range of approximately 0.02% to 1.0% by weight, although percentages within a range of approximately 1.0% to 10.0% may optionally be used.

Presently the most preferred embodiment of the invention has the advantages of reducing the difficulty in maintaining uniformity in the powdered metal mixture and in raising the percentage of heavy metal in the liner to higher levels than have been known in the art. Among the additional advantages, the need for lubricant additives and anti-corrosion additives are eliminated by the presence of a polymer coating, possessing both lubricative and anti-corrosive properties, on each metal particle.

An additional alternative embodiment of the invention uses a liner 26, which is constructed of a combination of the elements of the first two embodiments described. That is, a mixture of heavy metal powder and polymer binder powder may be used in combination with polymer-coated heavy metal powder to construct the liner 26. The same proportions and variations in ingredients described with reference to the first two embodiments may be employed with this additional embodiment as well.

The embodiments shown and described above are only exemplary. Many details are often found in the art such as: types of high explosives, size and shape of shaped charges, and configuration of perforating gun assemblies. Therefore, many such details are neither shown nor described. It is not claimed that all of the details, parts, elements, or steps described and shown were invented herein. Even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used in the attached claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims.

What is claimed:

1. A liner for a shaped charge comprising:

a mixture of powdered heavy metal and powdered polymer binder compressively formed into a rigid body.

2. A liner for a shaped charge according to claim 1 wherein the heavy metal powder is selected from the group consisting of tungsten, tantalum, hafnium, and copper.

3. A liner for a shaped charge according to claim 1 wherein the heavy metal powder is a mixture of any of the metals selected from the group consisting of tungsten, tantalum, hafnium, and copper.

4. A liner for a shaped charge according to claim 1 wherein the percentage of heavy metal in the mixture is within a range of approximately 90.0% to 99.98% by weight.

5. A liner for a shaped charge according to claim 1 wherein the percentage of heavy metal in the mixture is within a range of approximately 99.0% to 99.98% by weight.

6. A liner for a shaped charge according to claim 1 wherein the heavy metal in the mixture comprises tungsten.

7. A liner for a shaped charge according to claim 1 wherein the polymer comprises a fluorocarbon.

8. A liner for a shaped charge according to claim 1 wherein the polymer is selected from the group consisting of polytetrafluoroethylene, polybutadienes, and polyimides.

9. A liner for a shaped charge according to claim 1 wherein the polymer comprises TEFLON, a registered trademark.

10. A liner for a shaped charge according to claim 1 wherein the percentage of polymer in the mixture is within a range of approximately 0.02% to 10% by weight.

11. A liner for a shaped charge according to claim 1 wherein the percentage of polymer in the mixture is within a range of approximately 0.02% to 1.0% by weight.

12. A liner for a shaped charge according to claim 1 wherein the mixture further comprises approximately 0.02% to 1.0% lubricant by weight.

13. A liner for a shaped charge according to claim 12 wherein the lubricant comprises powdered graphite.

14. A liner for a shaped charge according to claim 12 wherein the lubricant comprises oil.

15. A liner for a shaped charge comprising:

a polymer-coated heavy metal powder compressively formed into a rigid body.

16. A liner for a shaped charge according to claim 15 wherein the heavy metal powder is selected from the group consisting of tungsten, tantalum, hafnium, and copper.

17. A liner for a shaped charge according to claim 15 wherein the heavy metal powder is a mixture of any of the metals selected from the group consisting of tungsten, tantalum, hafnium, and copper.

18. A liner for a shaped charge according to claim 15 wherein the percentage of heavy metal in the mixture is within a range of approximately 90.0% to 99.98% by weight.

19. A liner for a shaped charge according to claim 15 wherein the percentage of heavy metal in the mixture is within a range of approximately 99.0% to 99.98% by weight.

20. A liner for a shaped charge according to claim 15 wherein the heavy metal in the mixture comprises tungsten.

21. A liner for a shaped charge according to claim 15 wherein the polymer comprises a fluorocarbon.

22. A liner for a shaped charge according to claim 15 wherein the polymer is selected from the group consisting of polytetrafluoroethylene, polybutadienes, and polyimides.

23. A liner for a shaped charge according to claim 15 wherein the polymer comprises TEFLON, a registered trademark.

24. A liner for a shaped charge according to claim 15 wherein the percentage of polymer in the polymer-coated heavy metal powder is within a range of approximately 0.02% to 10.0% by weight.

25. A liner for a shaped charge according to claim 15 wherein the percentage of polymer in the polymer-coated heavy metal powder is within a range of approximately 0.02 to 1.0% by weight.

26. A liner for a shaped charge comprising:

a mixture of powdered heavy metal, powdered polymer binder and polymer-coated heavy metal powder;

the mixture compressively formed into a substantially conical rigid body.

27. A liner for a shaped charge according to claim 26 wherein the heavy metal powder is selected from the group consisting of tungsten, tantalum, hafnium, and copper.

28. A liner for a shaped charge according to claim 26 wherein the heavy metal powder is a mixture of any of the metals selected from the group consisting of tungsten, tantalum, hafnium, and copper.

29. A liner for a shaped charge according to claim 26 wherein the percentage of heavy metal in the mixture is within a range of approximately 90.0% to 99.98% by weight.

30. A liner for a shaped charge according to claim 26 wherein the percentage of heavy metal in the mixture is within a range of approximately 99.0% to 99.98% by weight.

31. A liner for a shaped charge according to claim 26 wherein the heavy metal in the mixture comprises tungsten.

32. A liner for a shaped charge according to claim 26 wherein the polymer comprises a fluorocarbon.

33. A liner for a shaped charge according to claim 26 wherein the polymer is selected from the group consisting of polytetrafluoroethylene, polybutadienes, and polyimides.

34. A liner for a shaped charge according to claim 26 wherein the polymer comprises TEFLON, a registered trademark.

35. A liner for a shaped charge according to claim 26 wherein the percentage of polymer in the polymer-coated heavy metal powder is within a range of approximately 0.02% to 10.0% by weight.

36. A liner for a shaped charge according to claim 26 wherein the percentage of polymer in the polymer-coated heavy metal powder is within a range of approximately 0.02 to 1.0% by weight.

37. A liner for a shaped charge according to claim 1 wherein the rigid body is substantially conical.

38. A liner for a shaped charge according to claim 15 wherein the rigid body is substantially conical.

39. A liner for a shaped charge according to claim 26 wherein the rigid body is substantially conical.

* * * * *